US007096694B2

(12) United States Patent
Nakamori

(10) Patent No.: US 7,096,694 B2
(45) Date of Patent: Aug. 29, 2006

(54) YARN FEEDER OF WEFT KNITTING MACHINE

(75) Inventor: Toshinori Nakamori, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/548,307

(22) PCT Filed: Mar. 1, 2004

(86) PCT No.: PCT/JP2004/002504

§ 371 (c)(1),
(2), (4) Date: Sep. 6, 2005

(87) PCT Pub. No.: WO2004/079072

PCT Pub. Date: Sep. 16, 2004

(65) Prior Publication Data

US 2006/0156762 A1 Jul. 20, 2006

(30) Foreign Application Priority Data

Mar. 7, 2003 (JP) ..... 2003-061946

(51) Int. Cl.
*D04B 15/52* (2006.01)

(52) U.S. Cl. ..... 66/126 A; 66/127

(58) Field of Classification Search ..... 66/127 R, 66/126 A, 127–129, 130, 133
See application file for complete search history.

(56) References Cited

U.S. PATENT DOCUMENTS 4,237,706 A 12/1980 Patthey
5,345,789 A * 9/1994 Yabuta ..... 66/126 A
5,557,948 A 9/1996 Shima et al.
6,021,651 A 2/2000 Shima
6,119,486 A 9/2000 Morita et al.
6,647,749 B1 * 11/2003 Ikoma ..... 66/126 A
6,981,393 B1 * 1/2006 Ikoma ..... 66/126 A
6,988,385 B1 * 1/2006 Miyamoto ..... 66/127

FOREIGN PATENT DOCUMENTS

JP 2002-327358 11/2002
WO 03/010378 2/2003

* cited by examiner

*Primary Examiner*—Danny Worrell
(74) *Attorney, Agent, or Firm*—Wenderoth, Lind & Ponack, L.L.P.

(57) ABSTRACT

A yarn feeder includes a switching mechanism for switching the position of a yarn feeding port, the switching mechanism further including a push-in operation member switchingly operating the height position of the yarn feeding port in association with entraining means, and the push-in operation member includes a pressing operation panel setting a yarn feeding position where the yarn feeding port mostly nears the knitting needle and an intermediate position where the yarn feeding port is positioned above the yarn feeding position and nearest the movable knitting member, so that a withdrawal position where the yarn feeding port is not operated by the push-in operation member, the intermediate position, and the yarn feeding position are formed in that order from the top, and the lift of the yarn feeding port is drivingly connected with the forward and backward movements of the movable knitting member so that the movable knitting member is retracted to open the mouth, the yarn feeding port lowers to the yarn feeding position, and at the intermediate position, the movable knitting member moves forward to a mouth clearance portion to close the mouth.

6 Claims, 9 Drawing Sheets

YARN FEEDER OF WEFT KNITTING MACHINE

TECHNICAL FIELD

The present invention relates to a yarn feeding device of a weft knitting machine constructed so as to entrain a yarn feeder, which is selected from a plurality of yarn feeders provided in a guide rail by entraining means, with a sliding drive mechanism.

BACKGROUND ART

In a yarn feeding device of a weft knitting machine, a guide rail slidably having a plurality of yarn feeders is arranged on a needle bed, and a yarn feeder selected from the plurality of yarn feeders by entraining means is entrained with a sliding drive mechanism, so that a yarn is fed into a knitting needle from a feeding port of the yarn feeder so as to form a knitting fabric.

In general, a yarn feeder slidably provided in a spinning rail has better yarn-feeding conditions, with its yarn-feeding port being positioned at a lower position as close as possible to the knitting needle.

However, when a plurality of yarn feeders are provided in one spinning rail, or a plurality of spinning rails, each having a yarn feeder, are provided, if the spinning rails are to be positioned in the vicinity of a mouth clearance for improving the yarn feeding conditions, the yarn-feeding ports are concentrated in excess so as to be possibly damaged due to interference with each other.

Then, during yarn feeding, operatively in association with that a yarn feeder selected from the plurality of yarn feeders by the entraining means is entrained with the sliding drive mechanism, the feeding port is pushed in the lower feeding position by pushing-in means. There is a structure in that when the entrainment by the entraining means is cancelled, operatively in association with the cancellation, the pushing by the pushing-in means is cancelled so as to raise the yarn-feeding port to a withdrawal position so as not to be damaged by interference with each other (see Japanese Unexamined Patent Application Publication No. 11-61606, for example).

As described above, when the formation is completed so that the entraining means stops the entrainment of the yarn feeder, operatively in association with the stoppage of the entrainment, the yarn-feeding port is raised from a yarn feed position to the withdrawal position.

In such a manner, in a state that a hook of a knitting needle is not completely closed, if the yarn-feeding port is raised higher to the withdrawal position, a knitting yarn gripped to the hook of the knitting needle may come off, or in a member closing the hook, a compound needle, for example, the knitting yarn may stick the slider.

The present invention has been proposed in view of the problems mentioned above, and it is an object thereof to allow a knitting yarn to be securely gripped by a hook of a knitting needle by lowering a yarn-feeding port as low as possible so as to improve yarn feeding conditions during yarn feeding for forming a knitting fabric.

DISCLOSURE OF INVENTION

In order to achieve the above-mentioned object, a yarn feeding device of a weft knitting machine according to the present invention includes at least one pair of needle beds slidably accommodating knitting needles arranged in a front-back direction in a state forming a mouth clearance; a movable knitting member operable in-and-out toward a mouth between the knitting needles of the needle bed; a guide rail having a plurality of yarn feeders slidably provided on the needle bed; entraining means for entraining yarn feeders selected from the plurality of yarn feeders with a sliding drive mechanism; and switching mechanisms provided for each of the plurality of yarn feeders, wherein the switching mechanism includes a push-in operation member switchingly operating the height position of a yarn feeding port in association with the entraining means, and the push-in operation member includes a pressing operation panel setting a yarn feeding position where the yarn feeding port mostly nears the knitting needle and an intermediate position where the yarn feeding port is positioned above the yarn feeding position and nearest the movable knitting member, so that a withdrawal position where the yarn feeding port is not operated by the push-in operation member, the intermediate position, and the yarn feeding position are formed in that order from the top, and wherein the lift of the yarn feeding port is drivingly connected with the forward and backward movements of the movable knitting member so that the movable knitting member is retracted to open the mouth, the yarn feeding port lowers to the yarn feeding position, and at the intermediate position, the movable knitting member moves forward to a mouth clearance portion to close the mouth.

The movable knitting member is formed of a yarn guide member having a knitting yarn guide surface and operable to proceed to and retract from the mouth clearance; the yarn feeding port is located at the intermediate position before a knitting needle disposed at a position at least close to the yarn feeding port and adjacent to one knitting needle retaining the loop finally knitted in the previous course among knitting needles located between the knitting needle retaining the finally knitted loop and the yarn feeding port proceeds to the mouth clearance; and the yarn feeding port is maintained at the intermediate position until a hook gripping the knitting yarn fed to the knitting needle at the knitting trailing end from the yarn feeding port at the yarn feeding position is lowered from the mouth and closed.

BEST MODE FOR CARRYING OUT THE INVENTION

A yarn feeding device of a weft knitting machine according to an embodiment of the present invention will be described below with reference to the drawings.

Figure 1:
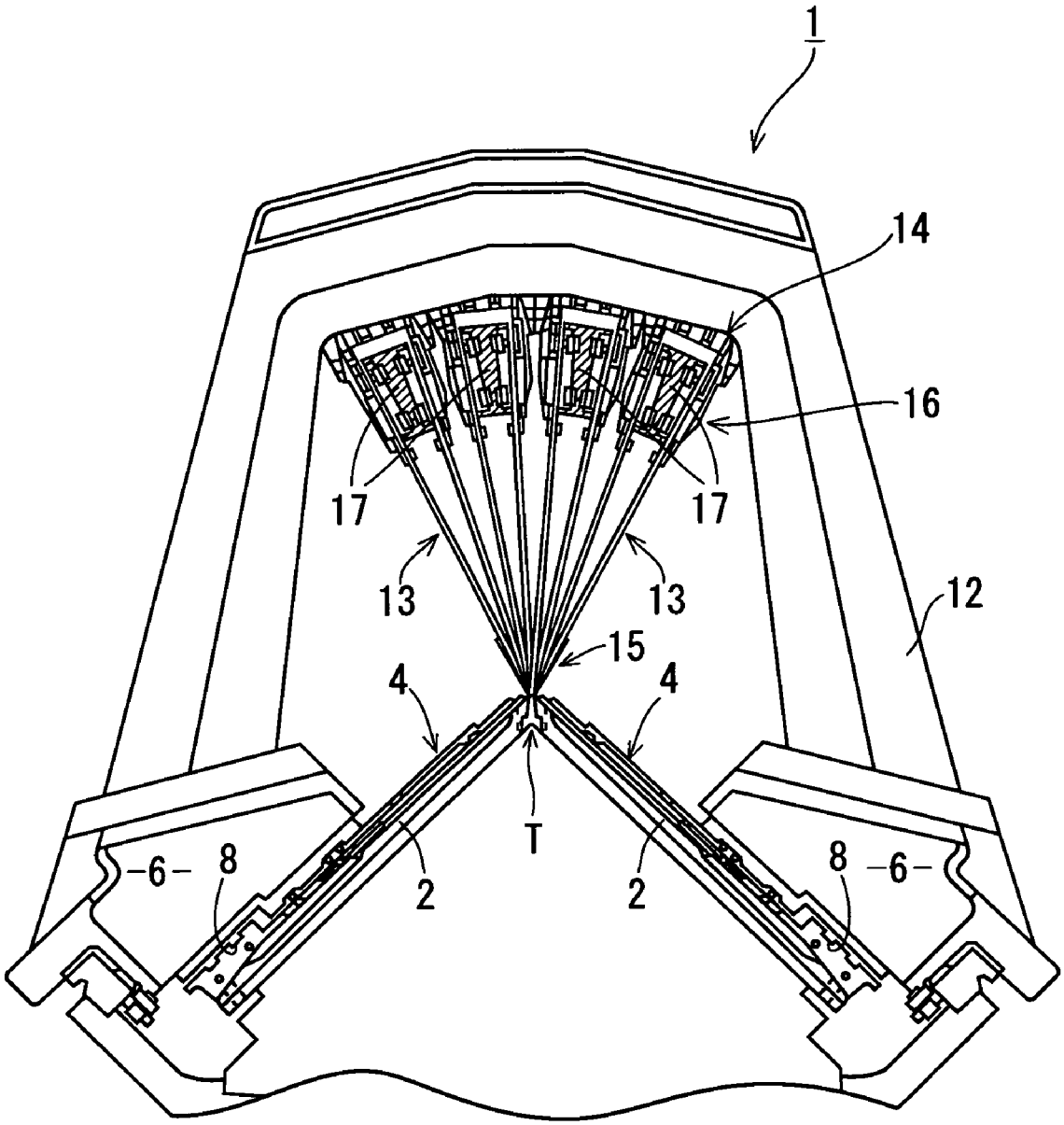
FIG. 1 is a side view of a weft knitting machine having a yarn feeder.

FIG. 1 is a side view showing a schematic structure of a weft knitting machine, and in the drawing, reference numeral 1 entirely denotes the weft knitting machine. The weft knitting machine 1 is provided with needle plates 3 shown in FIG. 2 and arranged at equal intervals above a needle bed 2. Between the needle plates 3 and 3, a plurality of compound needle type knitting needles 4, each having a slider 4*a* as shown in FIG. 3, and a plurality of yarn guide members (movable knitting members) 5 are independently juxtaposed in-and-out operatively. The needle beds 2 are arranged to oppose each other in a V-shaped side view in a state that ends of the knitting needles 4 come close to each other, and the needle bed 2 is provided with a movable sinker 7 arranged at its end to be swung by a carriage 6. Between the ends of the needle plates 3 and 3, a mouth gap T is formed, and the knitting needles 4 of both the needle beds 2 and the yarn guide members 5 are in-and-out operated with cams provided in the carriage 6.

Figure 4:
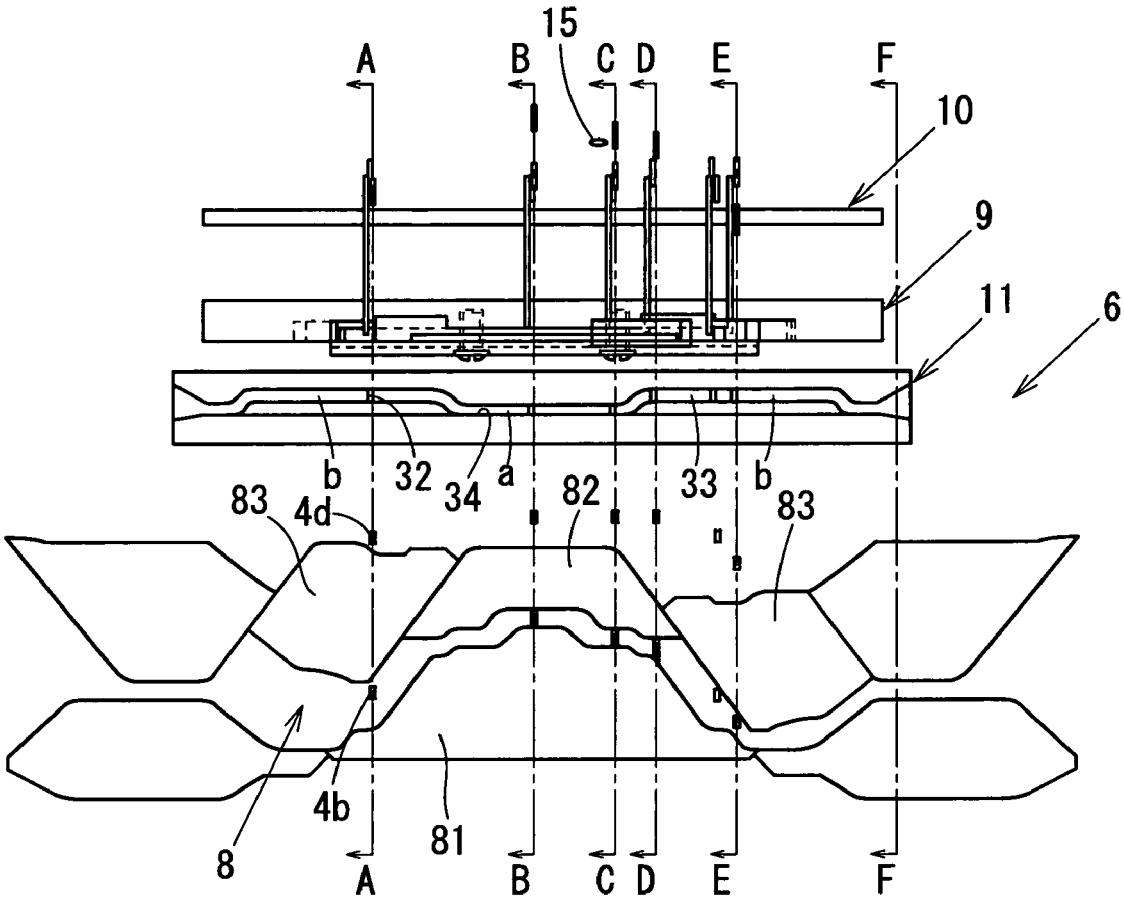
FIG. 4 is a development of a cam part of a carriage.

FIG. 4 is a development schematically showing a cam group arranged in the carriage 6 for in-and-out operating the knitting needles 4 of the needle beds 2 and for swingably operating the movable sinker 7, and in the drawing, reference numeral 8 denotes a knitting cam; numeral 9 a sinker-controlling rear cam arranged in front of the knitting cam 8; numeral 10 a sinker-controlling front cam arranged in front of the rear cam 9; and numeral 11 a controlling cam for in-and-out operating the yarn guide members 5.

The knitting cam 8 is provided with a raising cam 81 for acting on a butt 4*b* of the knitting needle 4 shown in FIG. 3 so as to in-and-out operate the knitting needle 4, a top center cam 82 arranged above the raising cam 81, and slidable stitch cams 83 arranged on both sides of the top center cam 82 for establishing a density.

The knitting cam 8 is formed in bilateral ax symmetry with respect to the apex of the raising cam 81 indicated by B of FIG. 4 so that the knitting needle operates in-and-out most efficiently for forming the fabric during the forward sliding of the carriage 6 on the needle bed 2 from the right to left and the backward sliding from the left to right.

Furthermore, the carriage 6, as shown in FIG. 1, is provided with a gate arm (sliding drive mechanism) 12 for integrally connecting the front-back needle beds 3 together by striding them. The gate arm 12 includes entraining means 14 for entraining a yarn feeder 13 and pushing-in means (switching mechanism) 16 for lowering a yarn-feeding port 15 to the vicinity of the ends of the knitting needles 4 and 4, which are mounted on the gate arm 12.

Above the needle beds 2, four spinning rails 17 are arranged along the front-back longitudinal direction of the needle beds 2.

Figure 6:
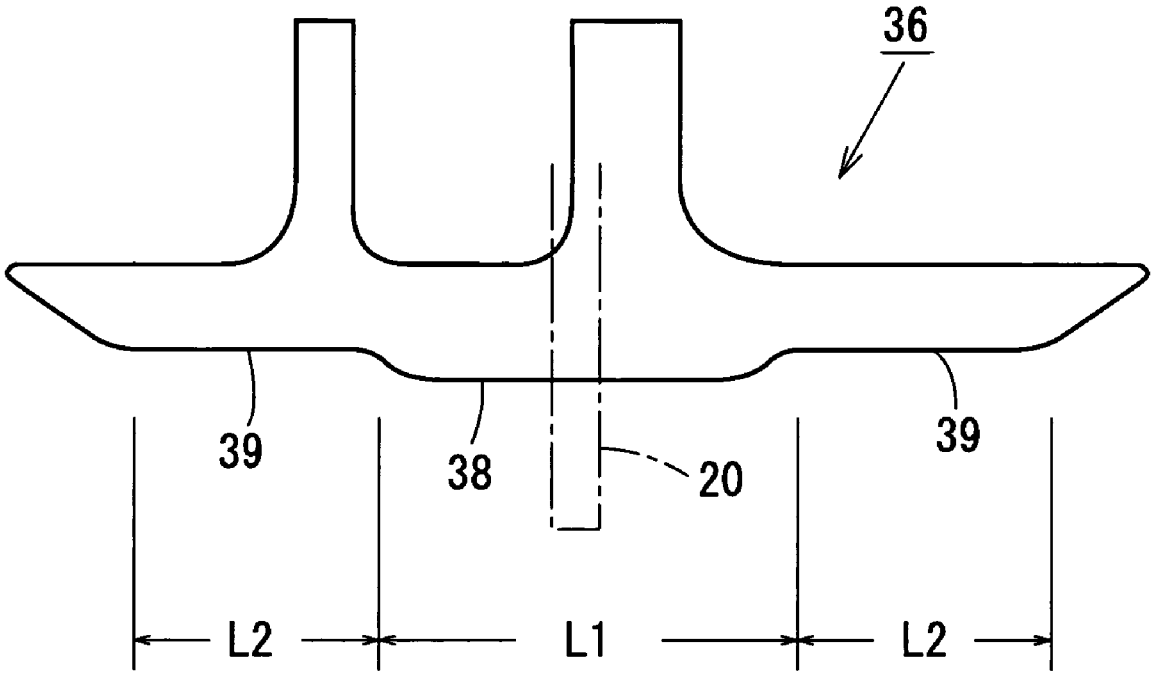
FIG. 6 is a front view of a cam plate.
Figure 7:
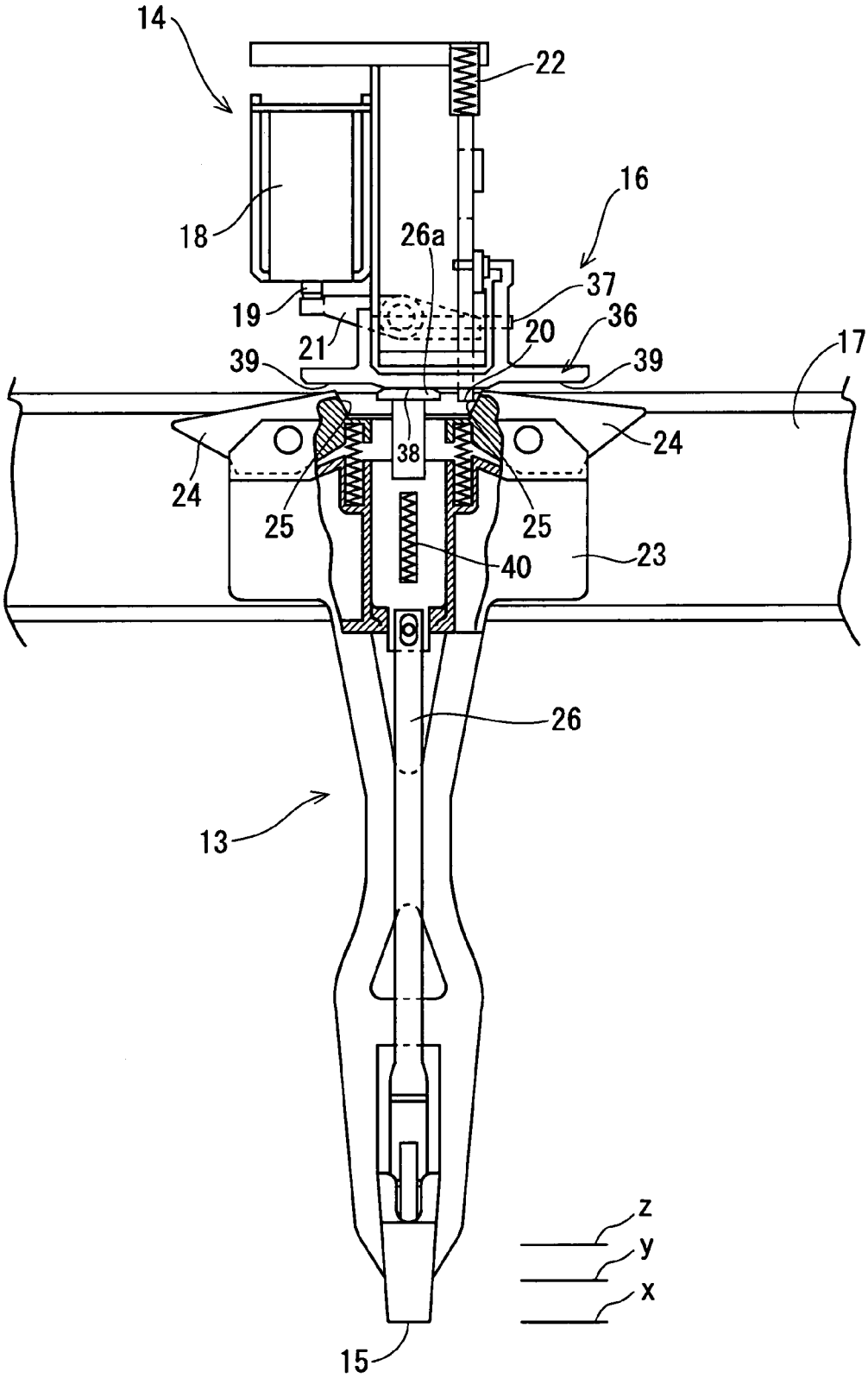
FIG. 7 is a front view of a yarn feeder part.

The entraining means 14 includes a transfer pole 21 for transferring the movement of an output shaft 19 of a solenoid 18 controlled to protrude/retract by an output signal from a controller (not shown) to an entraining pin 20 as shown in FIGS. 6 and 7. The entraining pin 20 is downward urged by a spring 22, and the yarn feeder 13 is entrained by bringing the entraining pin 20 into engagement with an engagement portion 25 formed in a lateral pair of swinging pieces 24 arranged at the upper central end of a feeder case 23 for each yarn feeder 13.

The yarn feeder 13 includes the feeder case 23 slidably supported to the spinning rails 17 and a yarn feeding pole 26 having the yarn-feeding port 15 arranged at the lower end below the feeder case 23, and the yarn feeding pole 26 is pivotably mounted on the feeder case 23 slidably in the vertical direction.

In an intermediate portion of the yarn feeding pole 26, a coil spring 40 is mounted so as to extend toward a spring receiving portion (not shown) of the feeder case 23 for upward urging the yarn-feeding port 15. The upper end 26*a*, which abuts a cam plate 36, of the yarn feeding pole 26 is outside projected, and part of the upper end 26*a* is protruded upward.

Figure 2:
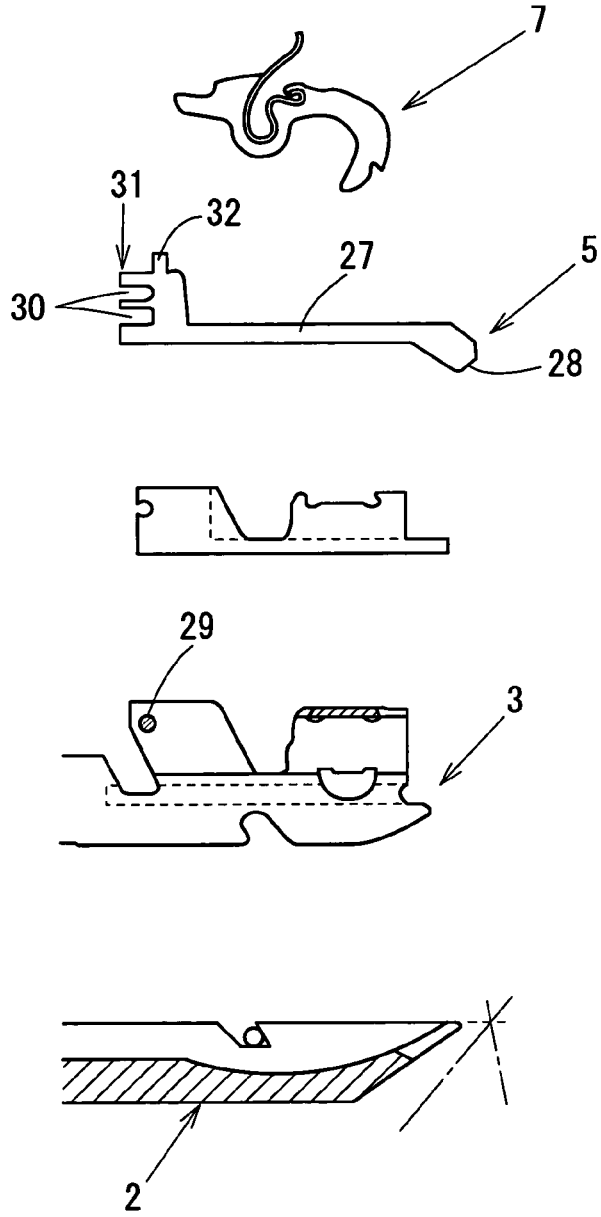
FIG. 2 is an exploded view of a needle bed part of the weft knitting machine.
Figure 3:
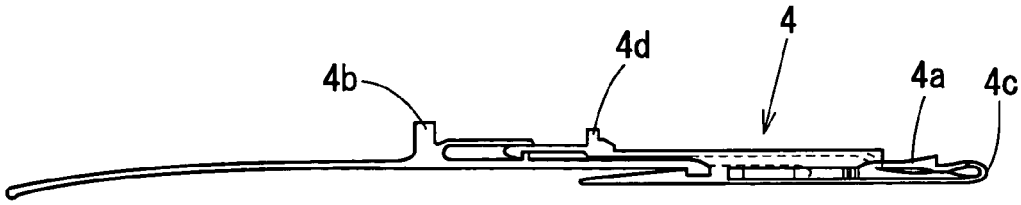
FIG. 3 is a side view of a knitting needle of the weft knitting machine.

In the yarn guide member 5, as shown in FIG. 2, at the front end of a body 27 made of a comparatively thin steel plate with a narrow width, a guide surface 28 is obliquely formed downward, and at the rear end thereof, a sliding guide portion 31 having vertical two-stage grooves 30 guided by a rotational pivoting rod 29 supported by the needle plates 3 and 3 is provided. At the upper end of the sliding guide portion 31, a butt 32 is erected to be operated in-and-out by a control cam 11.

The control cam 11 for operating the yarn guide members 5 in-and-out by operating the butt 32, as shown in FIG. 4, is formed of a band of cam groove 34 including a portion b for pushing out the yarn guide member 5 to the mouth clearance T at an intermediate height of a cam plate 33 with both-end portions and a portion a for operating in the yarn guide members 5 with the central portion.

In the pushing-in means 16 for pushing in the yarn feeding pole 26, the cam plate 36 is swung about a swing pivoting pin 37 in a front-back direction operatively in association with the vertical movement of the entraining pin 20 by connecting the other end of a connection plate 35 with one end connected to an intermediate height of the entraining pin 20 to the upper end of the cam plate (pushing-in operation portion) 36.

Figure 5:
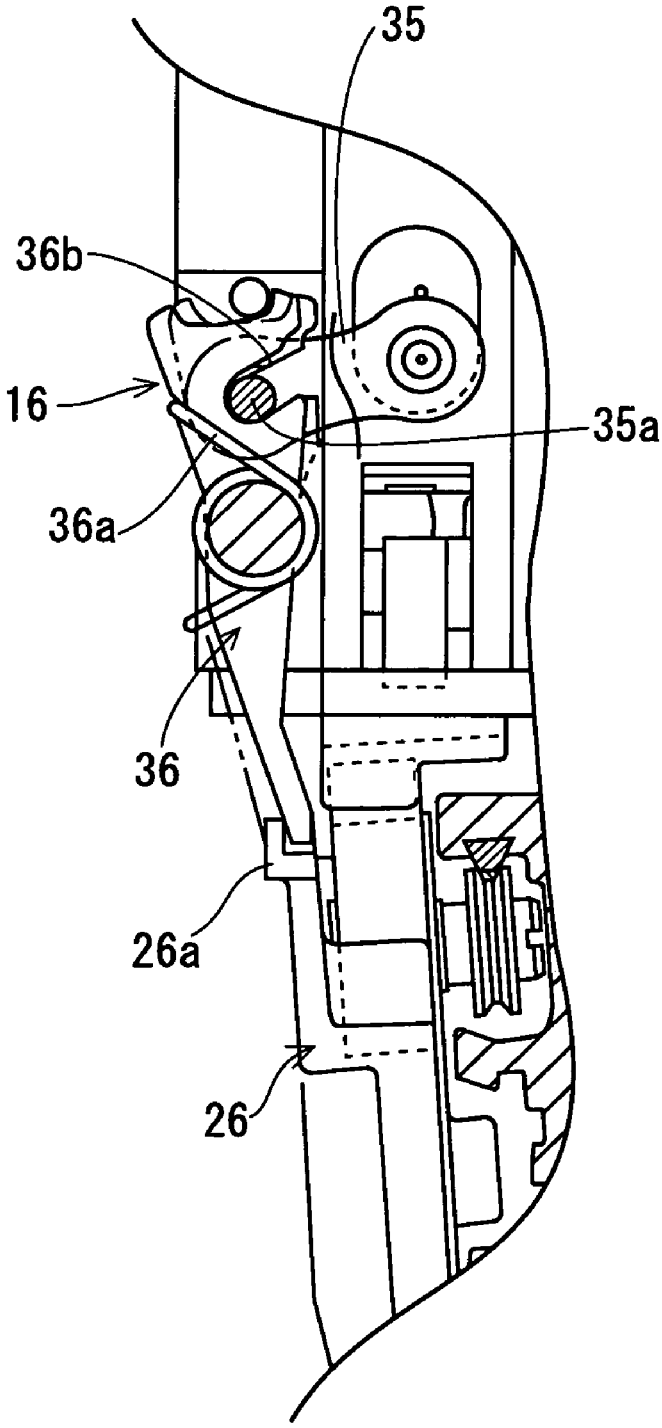
FIG. 5 is a partially broken side view of a cam plate part.

The below-mentioned cam surface of the cam plate 36, as shown in FIG. 5, is urged in a direction separating from the spinning rail 17 by a coiled spring 36. The cam plate 36 is connected to the connection plate 35 by bringing an engagement pin 35*a* provided on the connection plate 35 into engagement with a U-shaped groove 36*b* formed on the cam plate 36 at a position adjacent to its upper end.

On the central bottom surface of the cam plate 37, as shown in FIGS. 6 and 7, the flat spinning rail 17 is formed, and the entraining pin 20 is provided in the spinning rail 17 at a flat bottom central position of the cam plate 36.

The yarn-feeding position cam surface 38 of the cam plate 36 and intermediate position cam surfaces 39 arranged on its both sides are established in shape in accordance with the knitting cam 8 of the carriage 6 shown in FIG. 4. The positional relationship between the knitting cam 8 and the cam plate 36 will be described.

First, the yarn-feeding position cam surface 38 at the center of the cam plate 36 is required that when the yarn-feeding port 15 pushed in by the cam surface 38 is lowered to a yarn feeding position X of FIG. 7, the yarn guide member 5 located below the yarn-feeding port 15 opens the mouth clearance T so as to retract to the needle bed 2.

Accordingly, the yarn-feeding position cam surface 38 is established in length L1 in accordance with a portion, which is lowered by one Step in the drawing, of a cam groove 34 of the control cam 11 shown in FIG. 4.

Then, the intermediate position cam surfaces 39 arranged on both sides of the yarn-feeding position cam surface 38 are required that the yarn-feeding port 15 is maintained at a lower intermediate position to the vicinity of E position of FIG. 4, which is a position closing a hook 4*c*, in order that the butt 4*b* of the knitting needle 4 is pushed up by the raising cam 81; and the butt 4*b* starts to be lowered from position B of FIG. 4 by the top center cam 82 so that a yarn fed from the yarn-feeding port 15 to the hook 4*c* cannot come off the hook 4*c* or cannot be stuck by a member closing the hook 4*c* (a slider 4*a* in a compound needle, for example).

On the other hand, when a knitting yarn for tucking during returning knitting, or an adding yarn fed during formation knitting is necessary to be passed through the rear side of the knitting needle 4 proceeding to the mouth clearance T by the raising cam 81, the yarn feeding position is required to be lower, i.e., a nearest position to the mouth clearance T (intermediate position Y), preceding position A of FIG. 4, where the knitting needle 4 proceeds to the mouth clearance T by the raising cam 81, because the yarn guide member 5 proceeds to the mouth clearance T.

Accordingly, the intermediate position cam surface 39 is established in length L2 satisfying the all conditions mentioned above.

In FIGS. 3 and 4, reference numeral 4*d* denotes a butt of the slider 4*a* of a compound needle closing the hook 4*c*.

The operation of the yarn feeding device of the weft knitting machine according to the present invention will be described.

When the carriage 6 travels on the top surface of the needle bed 2 from the right to left by belt driving means due to the output signal of the controller, the knitting needles 4 juxtaposed in the needle bed 2 are in-and-out operated by the knitting cam 8.

During the traveling of the carriage 6, in the part where formation is not performed, the solenoid 18 is operated by an output signal for forming patterned knitting, so that the output shaft 19 is downward protruded and the entraining pin 20 of the entraining means 14 is raised via the transfer pole 21 against the tension of the spring 22.

Figure 8:
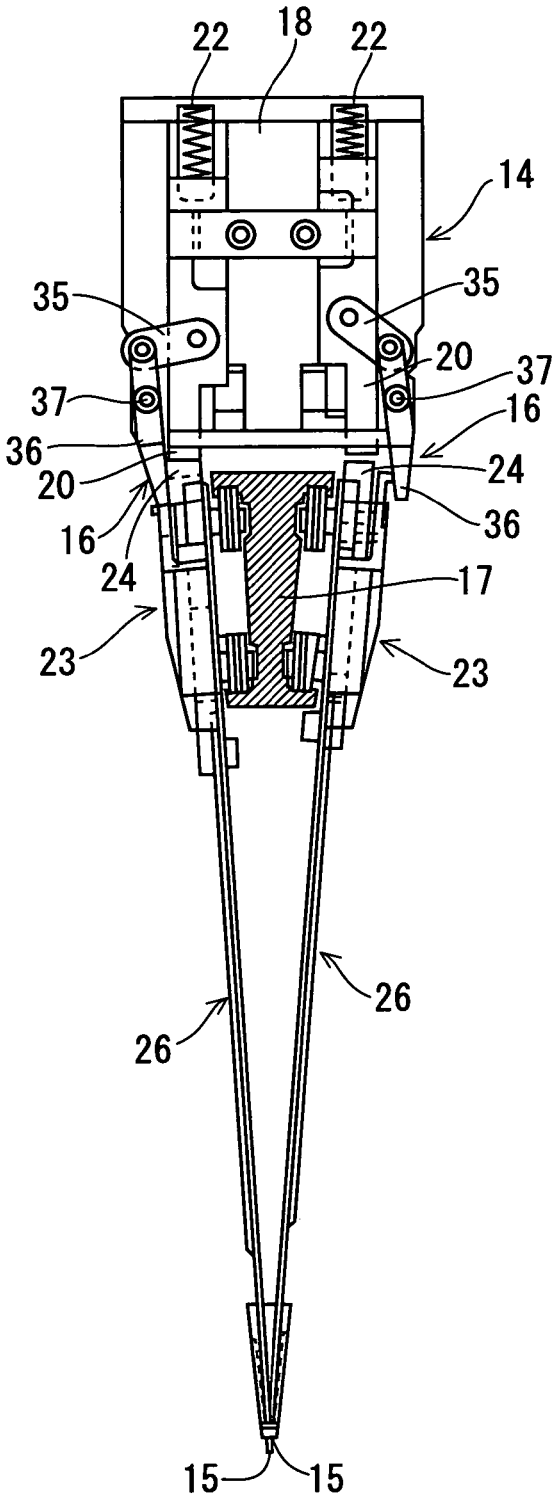
FIG. 8 is a side view of the yarn feeder part.

Following to the elevation of the entraining pin 20, the cam plate 36 of the pushing-in means 16 becomes a state thrown-up about the swing pivoting pin 37 (see the cam plate 36 on the right of FIG. 8).

In the part where formation is performed, at a near-side position facing a predetermined yarn feeder 13 feeding a yarn to the knitting needle 4 from the carriage 6, the solenoid 18 is operated by the output signal of the controller so that the output shaft 19 becomes an upward retracting state and the entraining pin 20, which has been raised until that time, is lowered by the tension of the spring 22. In association with the lowering of the entraining pin 20 operatively, the cam plate 36 of the pushing-in means 16 is swung about the swing pivoting pin 37 toward the yarn feeder 13 (see the cam plate 36 on the left of FIG. 8).

When the cam plate 36 is swung toward the yarn feeder 13 operatively in association with the lowering of the entraining pin 20, the upper end of the yarn feeding pole 26 is lowered against the urging force of the coil spring 40 by the sliding of the carriage 6, so that, as shown in FIG. 7, the yarn-feeding port 15 has a yarn feeding lowest position X close to the knitting needles 4 of the needle bed 2.

When the entraining pin 20 abuts the engagement portion 25 of the swinging piece 24 located at a downstream position in a proceeding direction by the further movement in the left of the carriage 6, the yarn feeder 13 becomes a state entrained by the carriage 6 so that the knitting is formed with a yarn fed from the yarn-feeding port 15 of the yarn feeder 13 to the knitting needle 4.

The operation of the yarn guide members 5 and the yarn-feeding port 15 of the knitting needle 4 during the knitting will be described in detail.

In a state that the carriage 6 moves from the right to left and at first, the butt 32 of the yarn guide member 5 proceeds with b portion of the cam groove 34 of the control cam 11 to the mouth clearance T, when the butt 32 of the knitting needle 4 is located at position A of FIG. 4, the butt 4*b* of the knitting needle 4 having an old loop (not shown) selected by a needle selector (not shown) is operated by the stitch cam 83 and the hook 4*c* at the end of the knitting needle 4 is once pushed in substantially the same position as that of the end of the needle plate 3.

Figure 10:
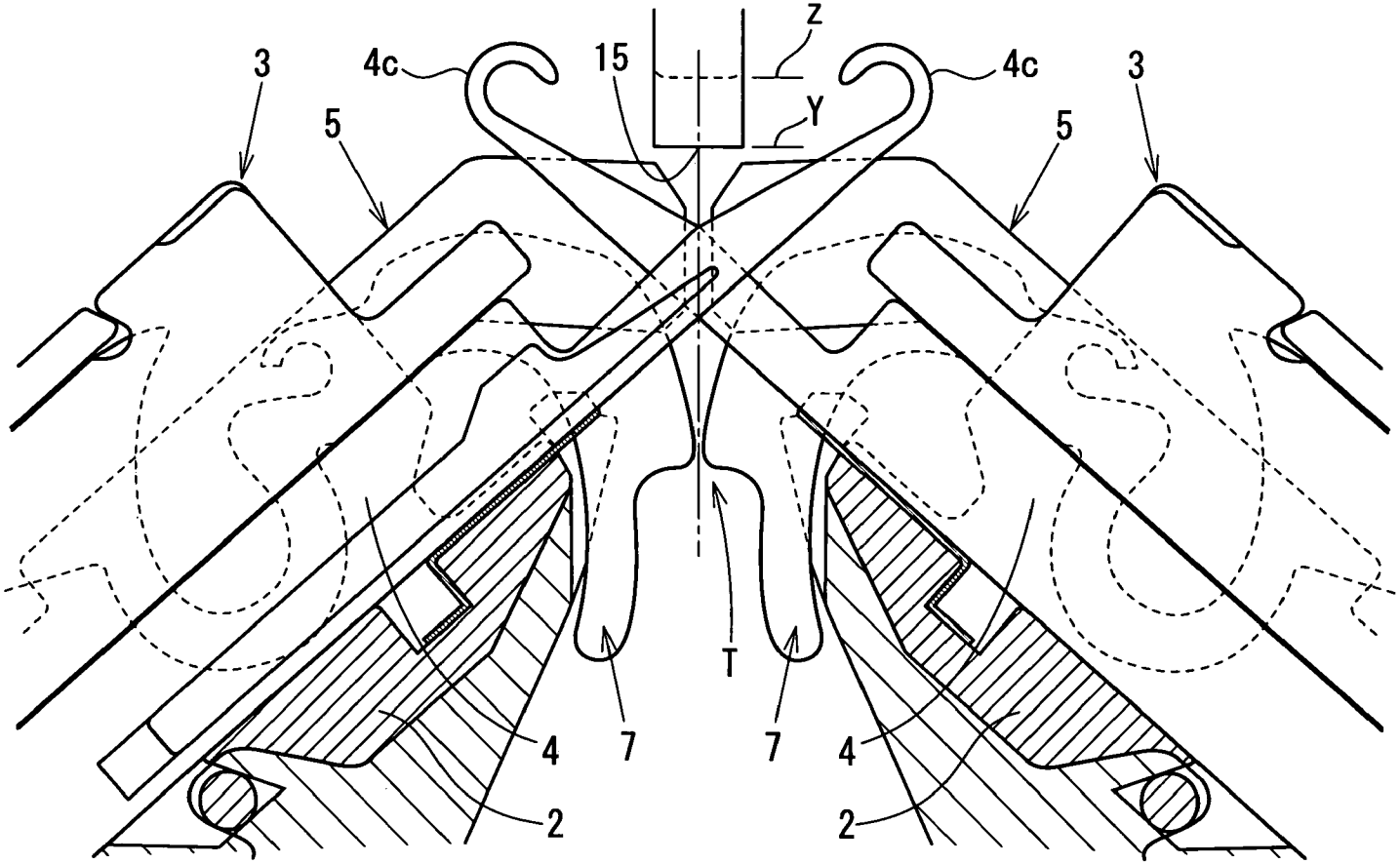
FIG. 10 is an explanatory view of the operation of the mouth portion in the weft knitting machine.

At this time, the yarn-feeding port 15 of the yarn feeder 13 is located at intermediate position Y nearest to the yarn guide members 5 on the intermediate position cam surfaces 39 of the cam plate 36 (see FIG. 10).

Figure 9:
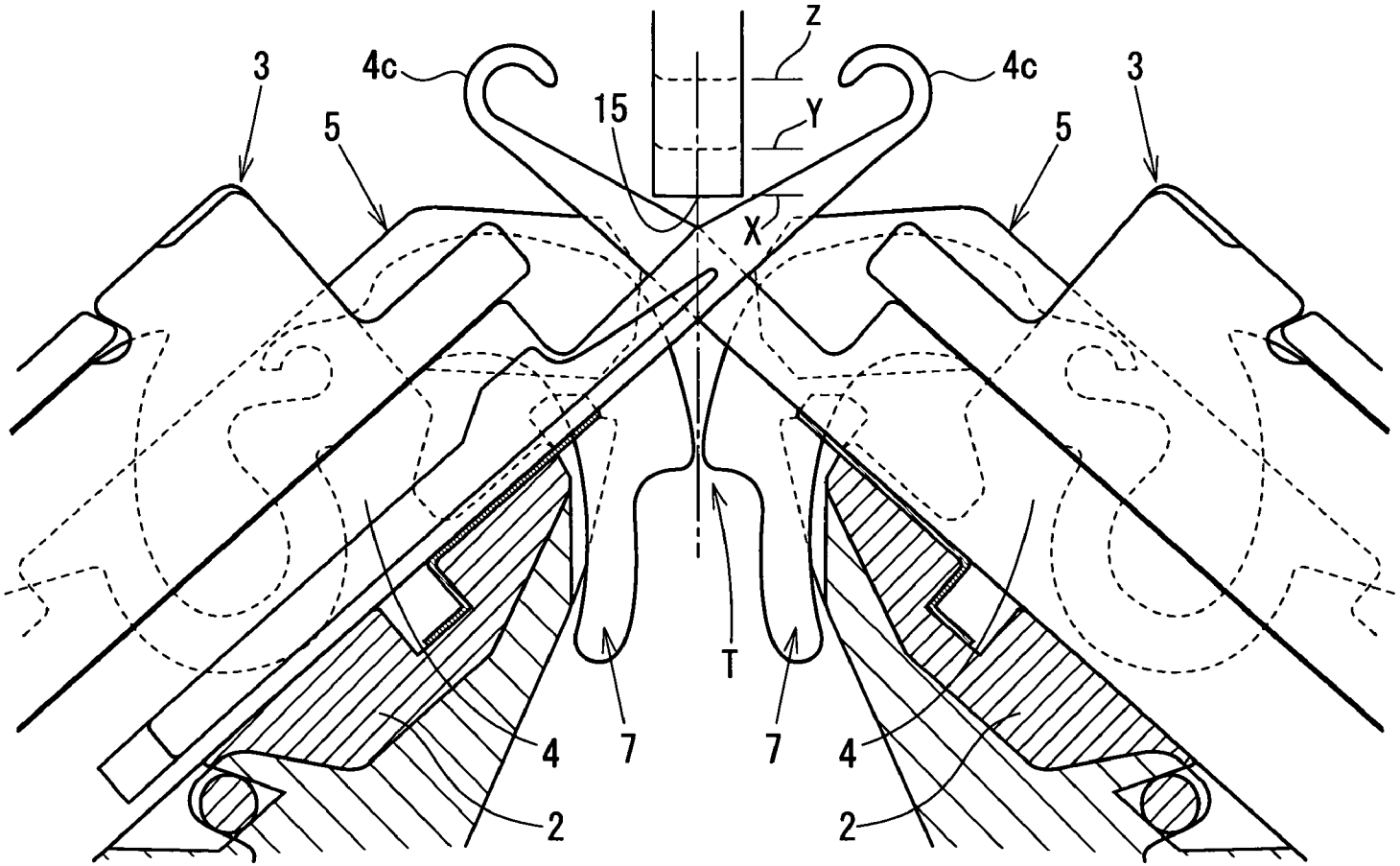
FIG. 9 is an explanatory view of the operation of a mouth portion in the weft knitting machine.

Then, the carriage 6 moves in the left, and the butt 32 of the yarn guide member 5 is transferred to portion a from portion a of the cam groove 34 of the control cam 11 so as to retract toward the needle bed 2 from the mouth clearance T to open the mouth clearance T. To the opened mouth clearance T, the yarn feeding pole 26 of the yarn guide member 5 is downward pushed by the yarn-feeding position cam surface 38 at the center of the cam plate 36 against the urging force of the coil spring 40 so that the yarn-feeding port 15 has yarn feeding position X nearest to the knitting needle 4 (see FIG. 9).

Then, at position B of FIG. 4 where the knitting needle 4 protrudes to the maximum, the slider 4*a* is left behind from the knitting needle 4, which is forcedly pushed out by the raising cam 81, so that the hook 4*c* of the knitting needle 4 is opened and the old loop held down by the sinker 7 is also left behind in the vicinity of the end of the needle bed 2 so as to be in a state running on the body of the knitting needle 4.

While the carriage 6 further travels to the left from position B of FIG. 4 and the butt 4*b* of the knitting needle 4 has position C, the butt 4*d* starts gradually descending by the top center cam 82 so that a knitting yarn is fed to the hook 4*c* of the knitting needle 4 from the yarn-feeding port 15 located in yarn feeding position X close to C.

After the knitting yarn is fed to the hook 4*c* of the knitting needle 4, while the butt 4*b* of the knitting needle 4 moves to position E from position D, the butt 4*b* of the knitting needle 4 is further lowered by the stitch cam 83 and the hook 4*c* of the knitting needle 4 is closed by the slider 4*a* which has been left behind during the proceeding of the knitting needle 4.

At this time, since the yarn-feeding port 15 is located at low intermediate position Y nearest to the yarn guide member 5, a knitting yarn fed to the hook 4*c* of the knitting needle 4 from position X cannot come off the hook 4*c* or cannot be stuck by the slider 4*a* closing the hook 4*c*, improving the knitting.

When the carriage 6 moves to the left and the butt 4*b* of the knitting needle 4 is located at position E, after the old loop, meanwhile, climbs over the closed hook 4*c* to be knocked over, the butt 4*b* of the knitting needle 4 is pulled in by the stitch cam 83, which is moving up and down, so as to establish a density.

Thereafter, when the butt 4*b* of the knitting needle 4 is located at position F, it is moved up so as to finish the knitting to be on standby for the next knitting. Such knitting is also performed during the returning of the carriage 6. By repeating such knitting, a knitting fabric is formed.

Toward the knitting completion, when the butt of the knitting needle 4 at the knitting trailing end is located at a position foreground E and crossing over D, the solenoid 18 is energized by the output signal of the controller, so that the entraining pin 20, which has been lowered up to that time, is pushed up against the tension of the spring 22.

In association with the moving up of the entraining pin 20 operatively, the cam plate 36 of the pushing-in means 16 is swung about the swing pivoting pin 37 in a direction separating from the yarn feeder 13. Since the upper end 26*a* of the yarn feeding pole 26, as shown in FIG. 5, is outward protruded, by the movement of the carriage 6, the upper end 26*a* is shifted from the yarn-feeding position cam surface 38 of the cam plate 36 to the intermediate position cam surface 39.

Since the intermediate position cam surface 39 is received by the upward projection of the upper end 26*a* of the yarn feeding pole 26, the yarn-feeding port 15 is located at intermediate position Y and maintained at the position until intermediate position Y passes through F from E of FIG. 4.

Thereby, the knitting yarn fed to the knitting needle 4 at the knitting trailing end cannot be stuck by the slider 4*a* closing the hook 4*c*, improving the knitting.

The knitting leading end of in the tucking during returning knitting and the adding yarn during formation knitting will be described.

The carriage 6 moves from the right to left, and the butt 32 of the yarn guide member 5 proceeds to the mouth clearance T in portion b of the cam groove 34 of the control cam 11. Before the butt 32 of the knitting needle 4 selected by a needle selector (not shown) passes through position A of FIG. 4 and is raised by the raising cam 81, when the upper end of the yarn feeding pole 26 of the yarn feeder 13 is pushed down by the intermediate position cam surface 39 of the cam plate 36, and a knitting yarn is fed from the yarn-feeding port 15 located in low intermediate position Y nearest to the yarn guide member 5, the knitting yarn is pushed by the knitting needle raised by the raising cam 81, the tucking (adding) can be performed.

In addition, according to the embodiment, the movable knitting member is formed of the yarn guide member 5; the invention is not limited to such a member, and any weft knitting machine having a member, such as a knit presser, capable of interfering with the yarn feeding port located at a yarn feeding position by haunting the mouth clearance T may incorporate the present invention.

Also, according to the embodiment, the knitting needle 4 is a compound needle; the invention is not limited to such a member, and a latch needle may be obviously used.

Furthermore, the needle bed is not limited to a pair of them as in the embodiment, and a machine having three or more needle beds may incorporate the present invention.

As described above, according to the present invention, a yarn feeder includes a switching mechanism for switching the position of a yarn feeding port, the switching mechanism further including a push-in operation member switchingly operating the height position of the yarn feeding port in association with entraining means, and the push-in operation member includes a pressing operation panel setting a yarn feeding position where the yarn feeding port mostly nears the knitting needle and an intermediate position where the yarn feeding port is positioned above the yarn feeding position and nearest the movable knitting member, so that a withdrawal position where the yarn feeding port is not operated by the push-in operation member, the intermediate position, and the yarn feeding position are formed in that order from the top, and the lift of the yarn feeding port is drivingly connected with the forward and backward movements of the movable knitting member so that the movable knitting member is retracted to open the mouth, the yarn feeding port lowers to the yarn feeding position, and at the intermediate position, the movable knitting member moves forward to a mouth clearance portion to close the mouth. Thereby, during the yarn feeding, the yarn feeding port of the yarn feeder is located at a low position nearest a knitting needle so as to improve yarn feeding conditions for preferable knitting.

The invention claimed is:

1. A yarn feeding device of a weft knitting machine comprising:

at least one pair of needle beds slidably accommodating knitting needles arranged in a front-back direction in a state forming a mouth clearance;

a movable knitting member operable in-and-out toward a mouth between the knitting needles of the needle bed;

a guide rail having a plurality of yarn feeders slidably provided on the needle bed;

entraining means for entraining yarn feeders selected from the plurality of yarn feeders with a sliding drive mechanism; and switching mechanisms provided for each of the plurality of yarn feeders, wherein the switching mechanism includes a push-in operation member switchingly operating the height position of a yarn feeding port in association with the entraining means, and the push-in operation member includes a pressing operation panel setting a yarn feeding position where the yarn feeding port mostly nears the knitting needle and an intermediate position where the yarn feeding port is positioned above the yarn feeding position and nearest the movable knitting member, so that a withdrawal position where the yarn feeding port is not operated by the push-in operation member, the intermediate position, and the yarn feeding position are formed in that order from the top, and wherein the lift of the yarn feeding port is drivingly connected with the forward and backward movements of the movable knitting member so that the movable knitting member is retracted to open the mouth, the yarn feeding port lowers to the yarn feeding position, and at the intermediate position, the movable knitting member moves forward to a mouth clearance portion to close the mouth.

2. The device according to claim 1, wherein the movable knitting member is formed of a yarn guide member having a knitting yarn guide surface and operable to proceed to and retract from the mouth clearance.

3. The device according to claim 1, wherein the yarn feeding port is located at the intermediate position before a knitting needle disposed at a position at least close to the yarn feeding port and adjacent to one knitting needle retaining the loop finally knitted in the previous course among knitting needles located between the knitting needle retaining the finally knitted loop and the yarn feeding port proceeds to the mouth clearance.

4. The device according to claim 1, wherein the yarn feeding port is maintained at the intermediate position until a hook gripping the knitting yarn fed to the knitting needle at the knitting trailing end from the yarn feeding port at the yarn feeding position is lowered from the mouth and closed.

5. The device according to claim 2, wherein the yarn feeding port is maintained at the intermediate position until a hook gripping the knitting yarn fed to the knitting needle at the knitting trailing end from the yarn feeding port at the yarn feeding position is lowered from the mouth and closed.

6. The device according to claim 3, wherein the yarn feeding port is maintained at the intermediate position until a hook gripping the knitting yarn fed to the knitting needle at the knitting trailing end from the yarn feeding port at the yarn feeding position is lowered from the mouth and closed.

* * * * *